US005551712A

United States Patent [19]

Repucci

[11] Patent Number: 5,551,712

[45] Date of Patent: Sep. 3, 1996

[54] SKATE BRAKE AND BRAKING SYSTEM

[76] Inventor: Richard M. Repucci, 44 Summer St., Medford, Mass. 02155

[21] Appl. No.: 433,003

[22] Filed: May 2, 1995

[51] Int. Cl.[6] ..... A63C 17/14

[52] U.S. Cl. ..... 280/11.2; 188/29

[58] Field of Search ..... 280/11.2, 11.21, 280/11.22; 188/29, 174, 176, 177

[56] References Cited

U.S. PATENT DOCUMENTS

| | | | |
|---|---|---|---|
| D. 315,941 | 4/1991 | Olson et al. . | |
| D. 324,252 | 2/1992 | Williamson . | |
| D. 353,429 | 12/1994 | Gay et al. . | |
| D. 353,430 | 12/1994 | Pratt et al. . | |
| 968,427 | 8/1910 | Simon | 280/11.2 |
| 3,025,930 | 3/1962 | Segal | 188/174 X |
| 3,436,088 | 4/1969 | Kunselman . | |
| 4,468,045 | 8/1984 | Sarazen . | |
| 4,570,955 | 2/1986 | Winkler et al. . | |
| 5,192,099 | 3/1993 | Riutta | 280/11.2 |

FOREIGN PATENT DOCUMENTS

| | | | |
|---|---|---|---|
| 3017556 | 11/1981 | Germany | 280/11.2 |
| 4022542 | 10/1994 | WIPO | 280/11.2 |

*Primary Examiner*—Josie Ballato

[57] ABSTRACT

A skate brake and braking system for in-line skates, roller skates and like devices is disclosed. The skate brake comprises of a chassis which is comprised of a set of aligned runners with slots located therein to accept an axle mounted wheel, springs to hold the axle to one end of the slots and an adjacent braking surface to contact the wheel when the spring force is overcome by the skater's weight. The braking system comprises of multiple brakes arranged in the same chassis and provided generally at the frontmost and rearmost runner positions, although other locations on a single chassis are possible. The advantages of the disclosed invention are an improved braking effect over previous designs allowing the skater to stop in short distances, the skater's ability to utilize his or her weight to control the braking action, the skater's ability to maintain balance on both skates when braking due to the mechanism being located under the skater's foot, the low cost and ease of manufacture of the design, the capability of securing the braking wheel for the purpose of pushing off and pivoting during skating to more adequately simulate ice skating and when multiple braking mechanisms are used at the frontmost and rearmost positions of the chassis, the ability to stop effectively in both the forward and backward moving directions.

6 Claims, 4 Drawing Sheets

SKATE BRAKE AND BRAKING SYSTEM

BACKGROUND OF THE INVENTION

This invention relates to a skate brake and braking system for the purpose of braking for in-line skates, roller skates and like devices.

In-line skating is one of the fastest growing sports in the United States today. It offers the skater many uniquely enjoyable and functional features, among them being a likeness to ice skating, an excellent exercise benefit and relative ease of use once the skating technique has been mastered. At the same time in-line skating has seen a tremendous rise in the rate of injuries, especially among young children, mostly due to the lack of an effective and easy to use braking mechanism.

Some commonly used braking devices offer little more than a fixed rubber snubber, cantilevered from the front or back of the skate, which requires the skater to shift his or her weight to the opposite skate, balance his or her body weight on this skate and then drag the snubber along the skating surface to effect a braking action. Stopping distances are often great with this design and some planning of when and where to stop is required before engaging the snubber. This design is of little value to the skater when a sudden stop is required. An improvement in design over the snubber is a braking mechanism which is attached to a pivoting a heel portion of the boot, which acts as a lever to push a rubber pad into the skating surface. The main advantages of this design is that it offers a more effective braking action for the skater than the snubber and allows for somewhat better balance to be maintained during braking as some weight is maintained on the braking skate. Disadvantages of this design are the technique required can be difficult to master, it can add a great deal of cost to a skate, thus is commonly used on only one skate and it is effective only in the forward skating direction. Another brake design uses calipers to clamp down on drums within the wheels and is actuated by a cable attached to a hand grip. This design also offers an improved braking effect over the snubber design yet, it can also add a great deal of cost to a skate and requires difficult to master hand to foot coordination. One other important disadvantage of in-line skates and roller skates is that it is difficult to push off or pivot from the toe or heel of the skate without the wheels being made to rotate. Unless the pushing skate is held in a near perpendicular position to the direction of skating the wheels will rotate making pushing off more difficult and awkward than ice skating, an effect which ice skaters who cross-train using in-line skates find to be a nuisance. The same wheel rotation effect takes place when pivoting on the rear or front wheel of the skate. In this case, pivoting can be unsafe as the wheel is allowed to rotate, often times rendering the skater out of control. Although a braking action can be effected with these designs they lack some important advantages and capabilities that are designed into my skate brake and braking system.

The first advantage of my skate brake and braking system is that it gives the skater an ability to shift his or her weight to a position directly over the braking mechanism and to use this weight to control the braking action of the skate, much as is done when ice skating. Because of this, better weight distribution is achieved and balance is maintained on both skates during braking. Another advantage of my skate brake and braking system is the ability to stop in short distances, again similar to ice skating, with little or no planning required due to the effectiveness of the braking mechanism. An additional advantage of my skate brake and braking system is the ability to stop effectively in both the forward and backward skating directions, when a braking mechanism is used at both the frontmost and rearmost wheel positions. Another additional advantage of my skate brake and braking system is the ability to use the braking mechanism to push off and pivot at both the toe and heel of the skate by securing the frontmost or rearmost braking wheel. This allows the skate to be held in line with the skating direction when pushing off and the wheel to be secured from rotation when pivoting, a great improvement over existing designs. In each respect, the pushing off and pivoting capability allow the skater to more effectively simulate ice skating than any other in-line or roller skating device available today. Another important advantage of my skate brake and braking system is, due to the minimal additional cost of the braking mechanism, it can be used on both skates in multiple positions and offers the individual an inexpensive alternative to other available braking mechanisms. This advantage in cost will also provide parents with the ability to easily purchase the disclosed invention on a child's pair of skates thereby protecting the most vulnerable and often injured group of skaters using in-line skates and roller skates today. An additional significant advantage of my skate brake and braking system is its ease of use, an important factor for beginners and small children. Another key benefit of my skate brake and braking system is its ease of manufacture, requiring little change to existing chassis molds. Additionally, my skate brake and braking system can also be applied to other like devices such as skate boards and roller skis. In essence, my skate brake and braking system offers the safest, least costly, most easily learned and effective braking mechanism available today for in-line skates, roller skates and like devices.

BRIEF DESCRIPTION OF THE DRAWINGS

In the drawings which illustrate the embodiments of my skate brake and braking system.

DESCRIPTION OF INVENTION

Figure 1:
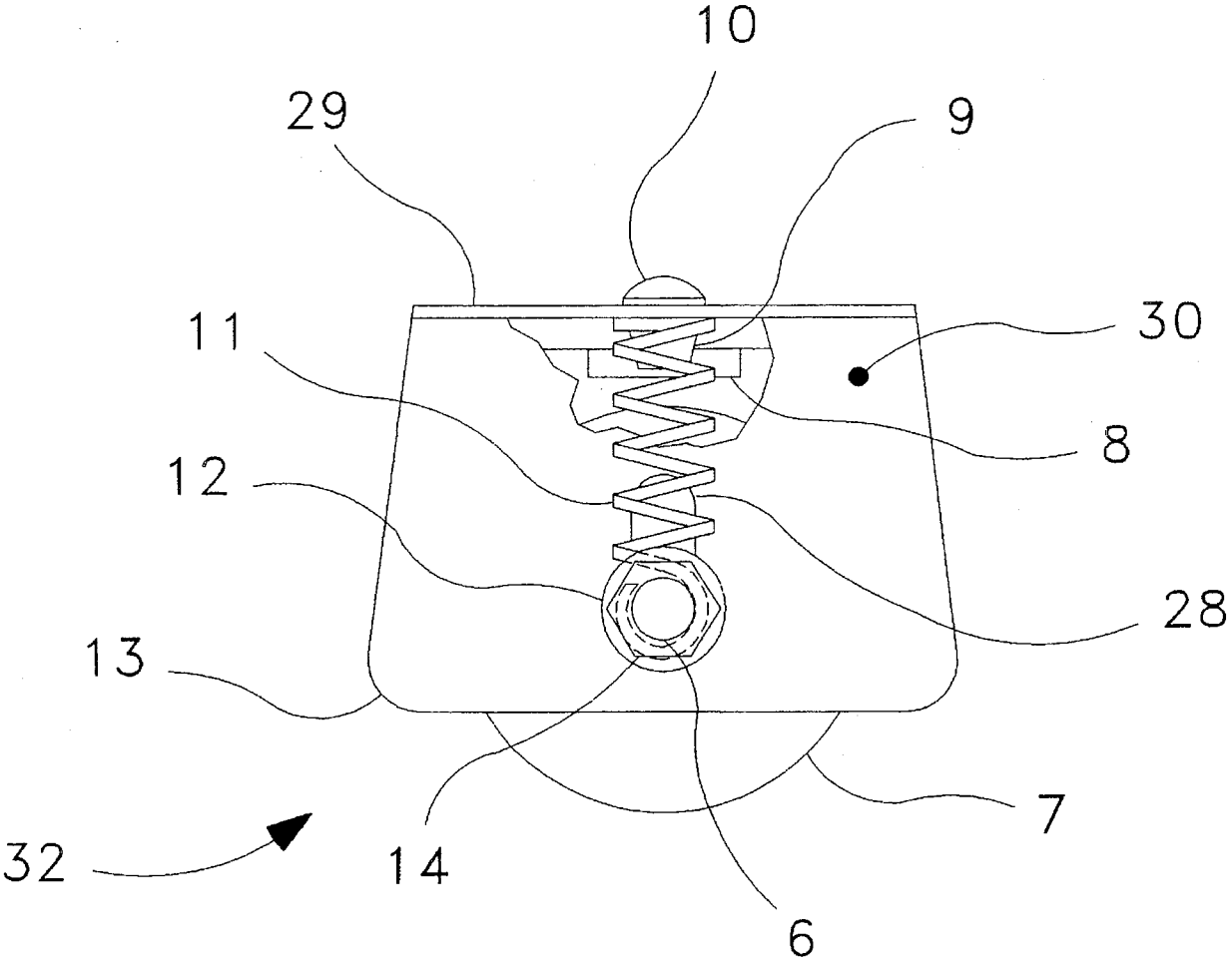
FIG. 1 is a side view of a single brake mechanism in accordance with the present invention.
Figure 2:
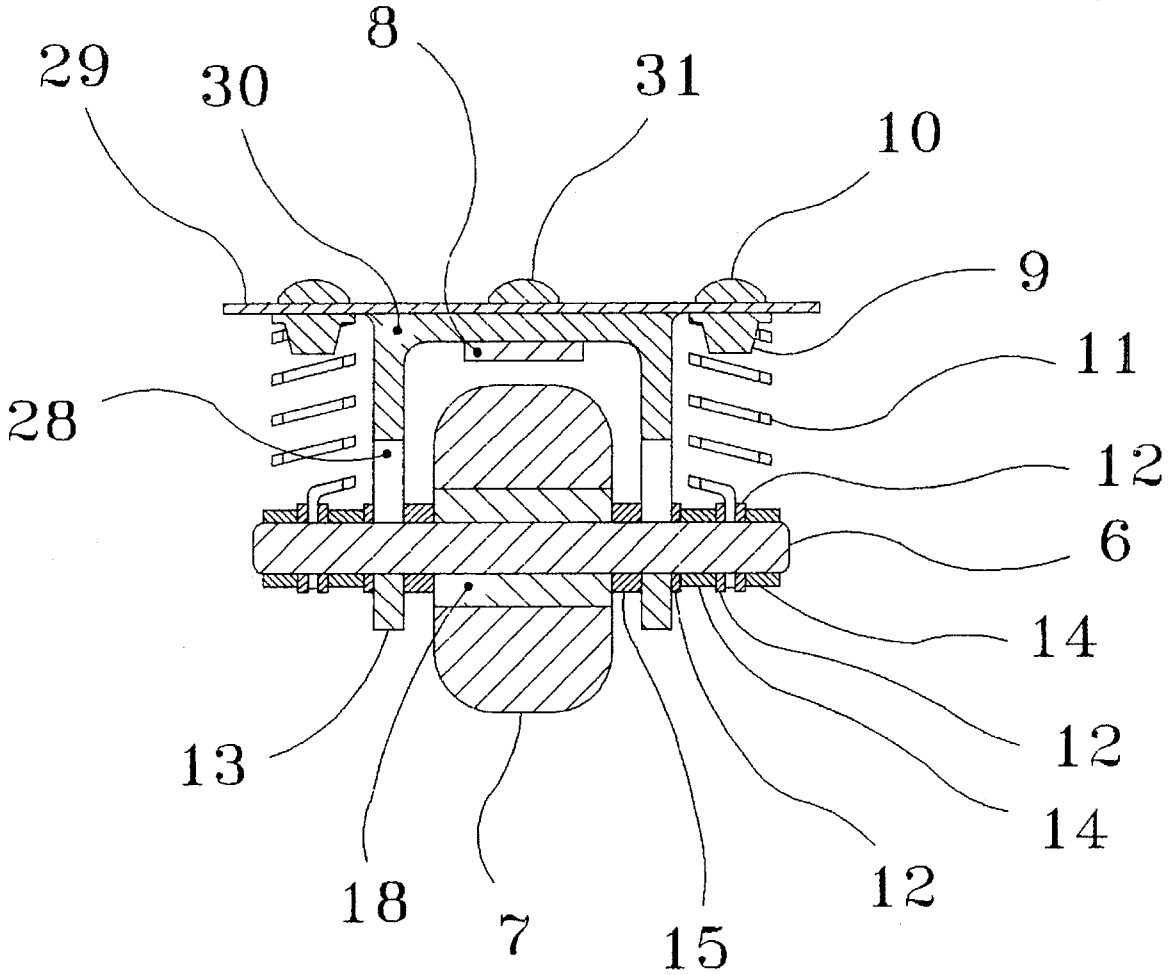
FIG. 2 is a crossectional front view of a single brake mechanism in accordance with the present invention.

The preferred embodiment of the disclosed invention is illustrated in FIG. 1 (side view) and FIG. 2 (crossectional front view). A chassis 30 comprises of aligned runners 13 with a common top surface 29 and consists of a material of sufficient strength and durability to support a skater's weight and bear repeated loading without permanent deformation. In the preferred embodiment of FIG. 1 and FIG. 2 chassis 30 comprises of a stiff, tough plastic such as ABS (acrylonitrile-butadiene-styrene) or of steel or aluminum. However, chassis 30 can consist of any material which can support a skater's weight and bear repeated loading without permanent deformation such as polycarbonate, nylon, vinyl or various filled plastic materials, metals or alloys, cast plastic, cast metal, sintered metal, laminates, wood, fibrous or impregnated materials or various other material combinations. Located in chassis 30 and within each runner 13 is a longitudinal slot 28 into which an axle 6 is set and held against one end of slots 28 by way of springs 11. In the preferred embodiment, axle 6 comprises of shaft steel with a hardened surface and is externally threaded at each end. However, the axle can consist of hardened aluminum, brass, bronze or other hardenable material or alloy, crystalline plastic or various other materials with a hardened surface or composition which provides adequate strength and a sufficient wear surface for contact with a weight bearing rotational means. In the preferred embodiment, springs 11 comprise of spring steel or other material able to withstand repeated loading and unloading without loss of spring force. However, the springs can consist of aluminum, brass, bronze or other metal, plastic or alloy, plastic laminate, rubber, foam or synthetic elastomer. In the preferred embodiment, springs 11 are attached to axle 6 by wrapping one end of spring 11 around axle 6 and securing it in position by threading nuts 14 around the threaded end of axle 6 to provide sufficient holding force to retain spring 11 during use. In the preferred embodiment, spacers or washers 12 of any suitable material are interposed between nuts 14 and wrapped ends of spring 11, between nut 14 and runner 13 and between the wheel race 18 and runner 13. However, other arrangements are possible such as using no washers or spacers, the use of locking nuts, caps or retaining clips set into grooves at the outer ends of the axle, welding the spring ends to the axle or placing the spring ends through the axle and bending spring ends perpendicular to the axle surface. In the preferred embodiment, an internally threaded spring retainer 9 is located under top surface 29 of chassis 30, in line with spring 11, set inside of the spring coil and is attached by way of a screw 10 projecting through a hole in top surface 29 and threaded into the internal threads of retainer 9. However, the retainer can have any suitable shape and be welded to chassis 30 or comprise part of chassis 30 such as when a protrusion or hole is molded into the chassis for holding the spring, as part of an injection molded plastic or cast plastic or cast metal or sintered metal chassis. In the preferred embodiment, an elastomeric wheel 7 is set onto axle 6 between runners 13 and fit of sufficiently close tolerance to allow uniform rotational motion around axle 6. However, wheels can consist of metal, plastic, rubber, other synthetic elastomers, wood or other like materials. Wheels can be fixed to an axle in such fashion so that the axle and wheel rotate together or can be set on pins or screws protruding from each runner or in the case when a wheel and axle are fixed together, an axle can be set into bearings. In the preferred embodiment, a pad 8 with an internally threaded hole is attached to top surface 29 of chassis 30 by way of a screw 31 protruding through a hole in top surface 29 and being threaded into pad 8 with said pad being located between runners 13 and above wheel 7. In the preferred embodiment, pad 8 comprises of steel although other metals or plastic or fiberous materials can be used which provide a suitable braking and wear surface or the pad can be an integral part of an injection molded plastic or cast plastic or cast metal or other cast or sintered material chassis 30.

Figure 3:
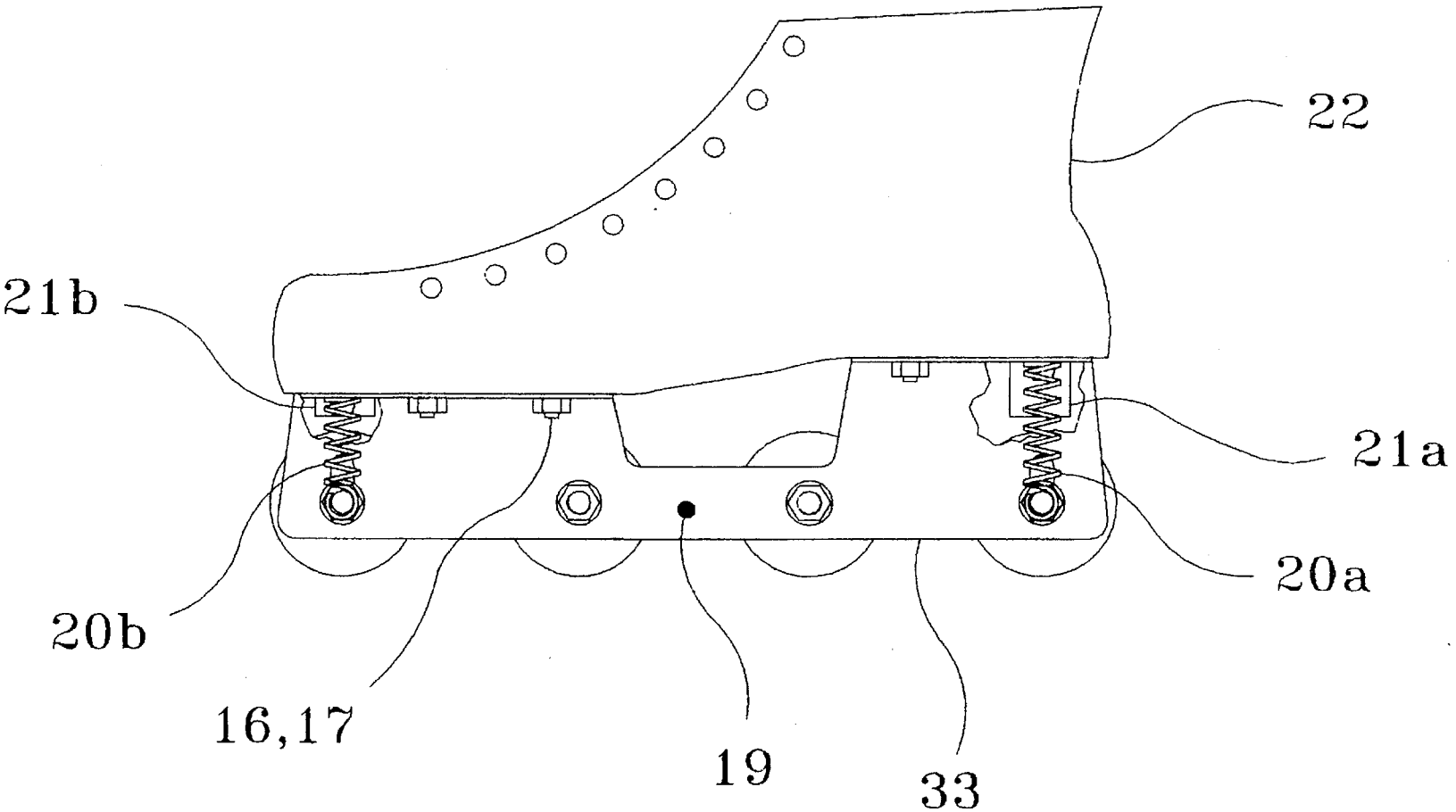
FIG. 3 is a side view of the braking system in accordance with the present invention.

In another embodiment of the disclosed invention shown in FIG. 3, a brake assembly 32 is integral to a skate chassis 19 in which brake assembly 32 is located at the frontmost and rearmost positions skate chassis 19, although various other locations for the brake assembly 32 on chassis 19 are possible. In the embodiment of FIG. 3 a boot 22 is attached to skate chassis 19 by way of screws 16 which protrude through holes in the bottom surface of boot 22 and through holes in skate top surface 27 of skate chassis 19 and are secured preferably although not necessarily, by locking nuts 17. However, other methods of fixing a boot, shoe or other surface for holding a human foot to a chassis are possible such as welding, use of an adhesive, riveting, use of hook and loop fasteners, sewing, tying, strapping, clamping or magnetic attraction.

Figure 4:
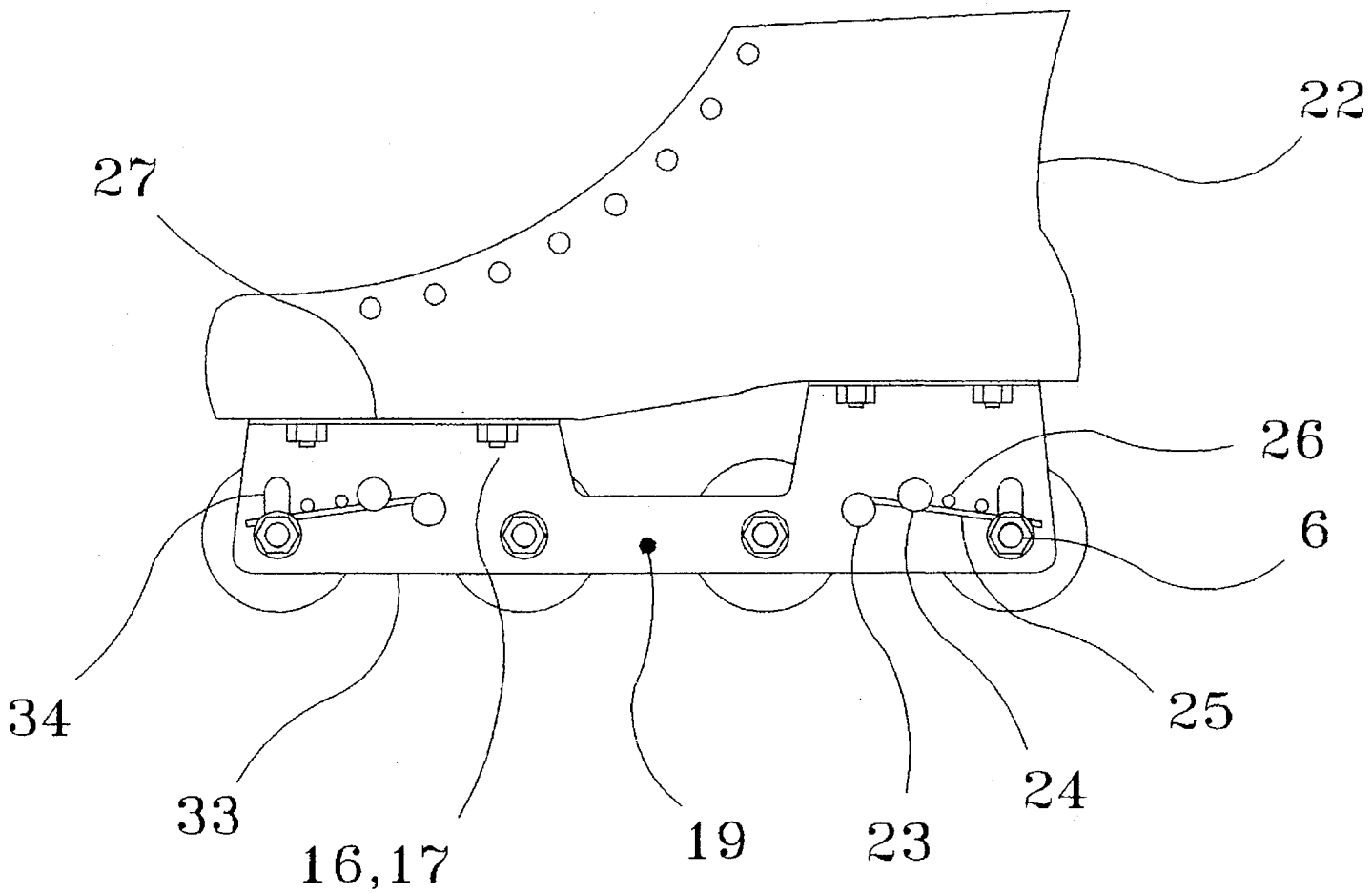
FIG. 4 is a side view of an alternate design of the braking system showing in accordance with the present invention.

In an alternative embodiment of the disclosed invention shown in FIG. 4, a lever spring 25 is used to hold axle 6 to one end of skate slots 34. In the embodiment of FIG. 4, spring 25 comprises of spring steel although use of other metals, plastics, laminates, alloys or fiberous material are possible. In the embodiment of FIG. 4, spring 25 is attached to a fixed pin 23 which serves as a fulcrum for spring 25. Pin 24 is set into any of a series of holes 26 to shorten or lengthen effective spring 25 length. However, more or less holes can be used if desired to hold pin 24 or a slot or aperture can be provided into which pins or like components can be set.

In the embodiments of FIG. 3 and FIG. 4 boot 22, can be a shoe or like device such as a board, ski or other surface used to support the human foot.

OPERATION OF THE INVENTION—FIGS. 1 & 2

The manner of using my skate brake and braking system is as follows:

With axle 6 set against end of slots 28 farthest from pad 8 and with wheel 7 in a freely rotating position, the skater applies a force to top surface 29 which has a component along slots 28 in the longitudinal direction. When the force component has a value greater than the combined spring 11 force and when an equal force of opposite direction exists on the outer surface of wheel 7, then axle 6 and wheel 7 will move through slots 28 and contact will occur between the outer surface of wheel 7 and pad 8. This will reduce or stop the rotational motion of wheel 7 and effect a braking action on wheel 7. To return wheel 7 to the original position at one end of slots 28 the skater must reduce the force component along slots 28 to a value below that of the combined spring 11 force. This will allow wheel 7 and axle 6 to move through slots 28 and back to original position at end of slots 28 farthest from pad 8 and contact between the outer surface of wheel 7 and pad 8 will cease, returning wheel 7 to a freely rotating position.

SUMMARY

Accordingly, the reader will see that my skate brake and braking system provides a greatly improved, economical, highly reliable, lightweight and safe device which can easily be learned to use by persons of almost any age. Furthermore, my skate brake and braking system has additional advantages in that;

- it permits highly effective braking action by skaters,
- it can be produced easily using simple, known manufacturing techniques,
- in the case when using an injection molded or cast chassis it will require little change to the mold design,
- when used at the frontmost and rearmost runner positions it will provide the skater with the ability to stop in both the forward and backward skating directions,
- when used at the frontmost and rearmost runner positions it will provide the skater with the ability to push off and pivot from the toe and heel of the skate more effectively simulating ice skating, it permits an easy modification of existing in-line skates to accommodate my skate brake and braking system, it can be adapted for use with skateboards and roller-skis, fit will permit longer wheel life due to a more even wear pattern on the skate wheel, it will allow more persons to purchase safe in-line skates and like devices due to its low cost, it will provide a reliable, longlasting braking mechanism due to the simplicity and ruggedness of its design.

Although the description above contains many specifications, these should not be construed as limiting the scope of the invention but merely as providing illustrations of some of the presently preferred embodiments of the invention. For example, the skate brake of FIG. 1 and FIG. 2 can be attached to any reasonable position on an in-line skate, roller skate, skate board, roller-ski or like device and can have other configurations such as a spring loaded wheel with longitudinal slots running parallel to the runners and which contacts an adjacent wheel or other surface, slots of a curved shape, slots with notches, a spring loaded wheel positioned between the skater's foot and another surface, a spring loaded loot support which contacts an adjacent surface, etc.

Thus the scope of the disclosed invention should be determined by the appended claims and their legal equivalents, rather than by the examples given.

I claim as my invention:

1. A brake for stopping the rolling motion of a skate comprising:

a) a chassis with slots as a means for guidance for enabling translation of a skate wheel axle in a direction which is generally perpendicular to an axis of rotation and to a direction of a skater's motion, b) a spring means with a spring means force for restraining the motion of said axle in said slots, and c) a friction pad or other surface means which bears against a skate wheel when a skater's weight or momentum is disposed to overcome said spring means force.

2. The brake of claim 1 wherein the spring means is a coil spring.

3. The brake of claim 1 wherein the spring means is a lever spring having a fixed pin fulcrum and at least one hole in said chassis into which a pin is placed to vary the spring means force applied to said axle and friction pad or other surface means for a given deflection of said lever spring.

4. The brake of claim 1 wherein said brake is mountable at various positions along a skate chassis.

5. The brake of claim 4 wherein said brake is mounted to a boot or other means for supporting a human foot.

6. The brake of claim 1 wherein said brake is mounted to a boot or other means for supporting a human foot.

* * * * *